United States Patent [19]

Radstake et al.

[11] 4,116,681

[45] Sep. 26, 1978

[54] PROCESS FOR THE MANUFACTURE OF ORE PELLETS

[75] Inventors: Herman Radstake, Uitgeest; Nicolas A. Hasenack, Heemskerk; Anthonie Van Latenstein, Santpoort; Jacobus J. Burger, Driehuis, all of Netherlands

[73] Assignee: Koninklijke Nederlandsche Hoogovens en Staalfabrieken N.V., Ijmuiden, Netherlands

[21] Appl. No.: 608,333

[22] Filed: Aug. 27, 1975

Related U.S. Application Data

[63] Continuation-in-part of Ser. No. 179,670, Sep. 13, 1971, abandoned.

[30] Foreign Application Priority Data

Sep. 11, 1970 [NL] Netherlands ..... 7013457

[51] Int. Cl.[2] ..... C21B 5/00

[52] U.S. Cl. ..... 75/41; 75/3; 75/5; 264/117; 264/122

[58] Field of Search ..... 264/117, 122; 75/3, 75/5

[56] References Cited

U.S. PATENT DOCUMENTS 2,743,172 4/1956 DeVaney ..... 75/3

3,555,133 1/1971 Gentaz ..... 264/117

OTHER PUBLICATIONS

Chem. Engr's. Handbook, by Perry et al., McGraw-Hill Book Co., New York, 1973, pp. 21-31 to 21-34.

*Primary Examiner*—Robert F. White
*Assistant Examiner*—James R. Hall
*Attorney, Agent, or Firm*—Hall & Houghton

[57] ABSTRACT

Ore pellets of homogeneous composition and loose consistency, free of pellet germs and having a reduced content of adhesive, are formed by dry mixing ore powder of particle size less than 90 microns (preferably about 65% less than 40 microns), with a moisture content of less than 0.1%, and powdered adhesive, e.g. bentonite, 0.05 to 1 percent by volume preferably added over a period of at least 1½ minutes; then adding to the dry mix 8 to 9% of water at 50° to 90° C., and then homogenizing by a plowing action by which the mass is torn and whipped apart without being allowed to perform a strong rolling action, preferably for only 50 to 90 seconds at a temperature of 60° to 70°, rubbing under pressure also being avoided, after which the mixture is formed into pellets with addition of 0.4 to 0.5% of water during the forming process. The formed pellets may be roasted, baked or sintered.

5 Claims, 2 Drawing Figures

HERMAN RADSTAKE, NICOLAS A. HAGENACK, ANTHONIE VAN LATENSTEIN, JACOBUS J. BURGER, MARTINUS LUTE, ANTONIO SINI
INVENTORS

BY Hall + Houghton

ATTORNEY

HERMAN RADSTAKE,
NICOLAS A. HASENACK,
ANTHONIE VAN LATENSTEIN,
JACOBUS J. BURGER,
MARTINUS LUTE,
ANTONIO SINI,
INVENTORS

BY Hall + Houghton
ATTORNEY

PROCESS FOR THE MANUFACTURE OF ORE PELLETS

This application is a continuation-in-part of our application Ser. No. 179,670 filed Sept. 13, 1971, which is now abandoned.

The invention relates to a process for the manufacturing of ore pellets, in which process a moist mixture of fine ore powder, i.e., ore flour, less than 1% of adhesive and about 8% of water, is formed into pellets by a rolling treatment after which the formed pellets are subsequently roasted, baked or sintered. Furthermore, the invention relates to the baked pellets manufactured in accordance with the process.

The lump ore and sinter employed heretofore as charge for blast furnaces are being replaced to an ever increasing extent by baked pellets. It has been found that by the use of baked pellets, the capacity of a blast furnace may be increased with a corresponding saving in the required quantity of coke being achieved. The best results have been obtained if the pellets employed possess a uniform shape, and, in addition to this, be sufficiently strong and are porous.

In order to produce such pellets, it has been found necessary that the starting mixture to be used in the rolling or forming of the pellets must meet very strict requirements. In particular, the material used to form the pellets should be very homogeneous, should have an accurately controlled moisture content, and should be free from so-called pellet germs. Furthermore, the material should possess an accurately determined adhesive content in order to provide the formed pellets with satisfactory cohesive strength prior to being baked.

It is noted that if there is an uneven distribution of moisture and adhesive in the mixture, this fact may cause the resulting pellets formed therefrom to have widely varying sizes and to possess very unsatisfactory cohesive strength before being baked. This will, in its turn, result in a great number of broken pellets and loose dust to be produced. In order to achieve an optimum result in the baking process of the pellets, as well as in the behavior of the pellets in the blast furnace, it is necessary that the pellets are nearly as uniform in size as possible, and as free from broken material and loose dust as is possible.

The presence of so-called pellet germs in the starting mixture to be employed in the formation of pellets will also cause the formed pellets to be of greatly varying sizes, which, as previously indicated, is an undesired characteristic. Moreover, an unsatisfactory mixing of the adhesive with the ore powder will require a very large quantity of adhesive to be present in the mixture if a satisfactory adhesive strength is to be obtained. Such improper mixing necessitates the use of much larger quantities of adhesive than the optimum quantities required to achieve the desired adhesive properties. Inasmuch as the cost of the adhesive forms a substantial part of the total production costs of the pellets, attempts have been made to limit the quantity of adhesive to be used as much as possible, i.e., to be sure that the mixing of the adhesive with the fine ore powder is as complete as possible.

It is known that the adhesive may be added to the mixture in the form of a thin aqueous suspension in water. It is also a common practice to mix the adhesive with a moist, doughy mass of the fine ore powder, i.e., ore flour. This ore powder will be in such a state due to the moist crushing or grinding process applied to the ore. The water may be added to the ore powder either before or simultaneously with the adding of the adhesive. It is common practice in most of the pellet manufacturing plants to utilize a moist crushing process due to the fact that there are no problems to be expected with such process insofar as the formation of dust is concerned. However, it has been found that even under the most favorable conditions, an absolutely homogeneous mixture of the adhesive with a moist ore powder mass cannot be achieved in this manner.

In the production of pellets by known manufacturing processes, the moist doughy mass is oftentimes first of all cooled to about 30° C and subsequently mixed and homogenized in drum mixers and twin-helix-mixers. In general, the occurrence of pellet germs, caused by the rolling and rubbing motion of the ore in the grinding apparatus, is considered to be unavoidable. Moreover, it is a generally accepted fact that the low temperatures of about 30° C or lower in the process are required in the application of the water into the mixture.

It is the object of the present invention to provide a process which will result in the production of a moist ore powder mixture which will be a desirable homogeneous composition and which, furthermore, will be of a loose consistency. Moreover, the resulting mixture will be free from pellet germs, while having a far lower percentage of adhesive than had been thought necessary heretofore. With the lower percentage of adhesive being present in the mixture before being baked, the so-called green or moist pellets, which will have a very satisfactory cohesive strength and be of a very uniform size may be manufactured at a lower cost.

The present invention includes the use of a fine ore powder or ore flour having a moisture content of less than 0.1% and a particle size of 90 $\mu$ which is first mixed with 0.05 to 1% by volume of a powdered adhesive, then 8 to 9% of water by weight is subsequently added thereto at a temperature of 50° to 90° C, and finally the entire mass is homogenized by a ploughing operation. By the use of the term of homogenized by ploughing as employed herein, it is intended to define an operation in which the mass of material on being homogenized is torn and whipped apart as much as possible without the material being allowed to achieve a strong rolling motion. Furthermore, the pulverizing of the material by rubbing under pressure is to be avoided as much as possible.

It is remarkable that the ore powder mixture is readily adaptable to be moistened at the aforementioned high temperatures. It has even been thought that such high temperatures may be essential to the obtainment of a satisfactory mixing of the materials. Inasmuch as mixing is carried out at such a higher temperature, it will also be noted that it will not be necessary to first cool the ore powder prior to mixing, which will have achieved an elevated temperature due to the initial pulverizing operation. Due to the use of the process of the present invention, there will be a considerable saving in cooling energy achieved. The cut in the quantity of the adhesive required, as a result of the process of the present invention will be found to be about 50% of the amount which heretofore was generally thought to be the usual quantity required in known processes. Due to the use of the fine particle sizes of the fine powder and the extremely low moisture content of the mixture, it has been found to be relatively simple to achieve an almost completely even distribution of the adhesive throughout the fine ore powder. The best results will be obtained in this connection in accordance with the present invention if a starting ore powder to be used is one in which approximately 65% of the powder will have a particle size of less than 40 μ.

Several adhesives are known in the art as suitable for use in manufacturing pellets. It has been proposed heretofore, for instance, to employ various plastics as the adhesive, or alternatively, clay-like natural products. Satisfactory results may be obtained in accordance with the present invention if bentonite is employed, such material being a known adhesive as such.

The use of a very small quantity of adhesive material in the mixture, in accordance with the invention, will insure a proper cohesive strength of the moist pellets can be obtained and also the low price of the bentonite in this respect to other conventional adhesives will be found to be an additional advantage.

As previously indicated, good results are obtained by forming the pellets from a mixture having a water content of 8 to 9%, and which is homogenized at a temperature of 50° to 90° C.

More particularly, it will be noted that the optimum moisture content of the moist pellets for the further processing of said pellets does not always correspond to the optimum moisture content of the ore powder mixture used for the formation of the moist pellets. It has been found in accordance with the present invention that it will be advantageous to add a small percentage of the necessary moisture that will be present in the moist pellets to the mixture during the forming of the pellets. Furthermore, the temperature at which both the homogenizing and the forming of the pellets will be carried out to achieve the optimum results is a rather critical factor. As a result thereof, it is preferred in accordance with the present invention to add approximately 8% water prior to the homogenizing step and an additional 0.4 to 0.5% during the pellet forming step and to have the homogenizing step take place while the mixture is at a temperature of 60° to 70° C. Due to the addition of more water during the forming of the pellets, it is noted that the outer skin of said pellets may contain somewhat more water than the core thereof or at least is not any drier as a result of the relatively high temperature at which the pellet forming step is carried out.

As previously indicated, it is desirable to achieve a very homogeneous mixture of ore powder, adhesive and water. It would be obvious to achieve this result by means of a very prolonged mixing and homogenizing operation. However, the disadvantage of such a procedure is that such material will reach a high temperature and will start to lose moisture. Furthermore, a prolonged mixing operation of this type requires the use of very bulky mixing equipment and the consumption of a substantial amount of mixing energy. The greatest disadvantage of a prolonged mixing operation consists, however, in that by subjecting the material to a prolonged mixing when the mixture is used to form pellets, the so-called pellet germs will start to occur in the material. The presence of pellet germs in the material may afterwards give rise to the formation of pellets which will have widely different sizes. The disadvantages thereof have already been discussed hereinbefore. Accordingly, it has been found desirable to employ a process in which the adhesive is added to the mixture during a period of at least 1½ minutes, and the homogenizing step is carried out during a period of 50 to 90 seconds. However, another important factor in the present process is the selection of the mixing apparatus to be employed. As a result of problems that have arisen in the mixing systems previously known in the art, attempts have often been made to solve such problems by using more complicated mixing plants, which may or may not be combined with means to obtain an additional cooling of the mixture. It has been proposed heretofore, for instance, to first of all cool the moist mixture until it has acquired a temperature of 30° C, and to pass the cooled mixture subsequently through a twin-helix-mixer. It has also been known in the art to first mix the moist material in a rotating mixing drum, to further moisten the mixture subsequently, and to homogenize the mixture in a twin-helix-mixer. Notwithstanding the fact that complicated and costly means have been employed heretofore, the formation of pellet germs in the mixture has not been prevented. This is probably due to the simultaneous rolling and rubbing motion to which the previously moistened material has been subjected in the mixing equipment. All of these disadvantages have been avoided in accordance with the invention by carrying out the mixing of the adhesive and the ore powder in a single-helix-mixer, and subsequently carrying out the homogenizing of the previously moistened material in a type of mixer which has been provided with asymmetric plough-shares rotating in a horizontal cylinder. Mixers of this type are known per se and are marketed by the firm of Lodige, among others. The material is constantly torn loose and whipped apart, and during the mixing step of this type simultaneously driven forward whereby a rolling motion of the mixture will be avoided as much as possible.

In practice, the manufacturing of baked pellets unavoidably results in the formation of ore dust. Furthermore, during the conveying of the ore powder, a great amount of so-called loose ore will be discharged at several points during its movement, which will cause environmental pollution in the plant as well as the surrounding environment. Pellet manufacturing plants, as a consequence, are provided at several places with dust removing equipment, suction dust extractors, flushing troughs, etc. The material thus discharged is preferably collected and fed back to the processing unit together with the so-called spilled water. This procedure is quite feasible with the process of the present invention so long as at least part of the water used contains ore powder, and that the total quantity of water required is adjusted by means of the adding of unpolluted water in relationship to the properties and the quantity of the water containing ore powder. It will also be found possible to add the water containing the ore powder and the spilled water from an intermediate storage point into the process, but in actual practice this procedure will give rise to serious problems. This is due to the substantial fouling of control valves or similar elements through which the flow would have to be adjusted. Therefore, it will be found to be simpler to measure the quantity of water containing the ore powder, and simultaneously to check how much water and how much ore powder is present in the flow. Dependency on the measured values, the total quantity of water required for the process, may be adjusted in a simple manner by the addition of the unpolluted water thereto. However, there is one condition attached to this procedure, this being that unpolluted water will be used at all times.

It is possible to mix the ore powder mixture batchwise. In such a case, a quantity of ore powder may be weighed for each successive batch and a proportionate quantity of bentonite added thereto. However, it will be found that for a plant having a substantial production capacity, such as batchwise mixing operation is difficult to conceive from a technical point of view. It is for that reason that the invention more particularly relates to a process in which the bentonite is continuously added to a continuous supply of ore powder, and is one in which the addition of the bentonite is adjusted in relationship to the measured rate of flow of ore powder, i.e., quantity per unit time.

It has been noted hereinbefore that in a process of the type described above, part of the water added may also contain ore powder. It will be obvious that the amount of ore powder present will affect the ratio between ore powder and the water. Inasmuch as a precise ratio is a very critical factor in the present process, the continuous mixing process will have to be corrected accordingly. This correction may be carried out by continuously determining the volume flow, i.e., volume per unit time, and the density of the water containing the ore powder, by determining the partial mass flows of the water and of the ore powder contained therein from these values, by determining the total quantity of water required in relationship to the total amount of ore powder supplied by the main flow of the powder and by the flow of water containing ore powder, and by controlling said total quantity of water required with the flow of unpolluted water in relationship to the determined partial flow of the water in the water containing the ore powder.

As has been noted hereinbefore, parts such as control valves and the like in the water stream containing the ore powder are subjected to considerable fouling. The same problem also arises, though to a lesser degree, when using the conventional apparatus for the determination of the quantity and the characteristics of the stream of water containing the ore powder. It has now been discovered that such disadvantages may be avoided by carrying out the process of the present invention in such a manner that the characteristics and the quantity of the flow of water containing the ore powder are determined by measuring the density of the flow by means of an absorption measurement for gamma-radiation, the volume flow with the aid of an electromagnetic flow meter, and the permeability. When taking said measurements, the water flow will not contain any material, so that there will be no danger of fouling or or blocking of the valves or the like.

By measuring the volume flow with the aid of an electromagnetic measuring device, an error may occur due to the fact that the magnetic permeability of the iron ore in the flowing mass will exceed 1.However, this error may be corrected by means of the permeability measurement. However, it is noted that in case the ore content in the water containing the ore powder is substantially constant, the permeability measurement may be replaced by a constant correction to the volume flow measurement by electromagnetic means.

From the measured density and the volume passing per unit time, which is determined by measurements and calculations, the quantities of water and ore powder which are fed to the ore powder mixture per unit time in the flow of water containing ore powder may be determined. This makes it possible to determine and control the definite composition of the final mixture. As mentioned hereinbefore, it is preferable to additionally add 0.4 to 0.5% of water to the fine ore mixture in the pellet forming step. In accordance with the present invention, an important improvement is possible if this additional water is added to the ore in a way such that it will be evenly distributed over the greater part of the length of the pellet forming zone. Thus, the forming of the pellets in the entire forming zone will be carried out under optimum conditions. This therefore will result in an increase of the output of the pellet forming stage of at least 35%. In this respect particularly good results have been obtained by forming the ore pellets in a forming drum, and by adding the additional water to the mixture over at least 70% of the length of the forming drum.

As a result of the accurate composition of the final mixture, and as a result of achieving a very homogeneous mixture having a loose structure therein, not only the process of forming the pellets will be found to be less expensive, more effective, and will yield fewer rejects, but it will also be found that the final baked pellets are of exceptionally high-grade quality and will lead to better results when used in the blast furnace operation. This is particularly true when the increase in blast furnace production and the decrease in the consumption of coke are considered. Accordingly, the present invention relates to the pellets manufactured in accordance with the new process.

Reference is now to be had to the accompanying drawings wherein the process of the present invention is explained in greater detail.

Figure 1:
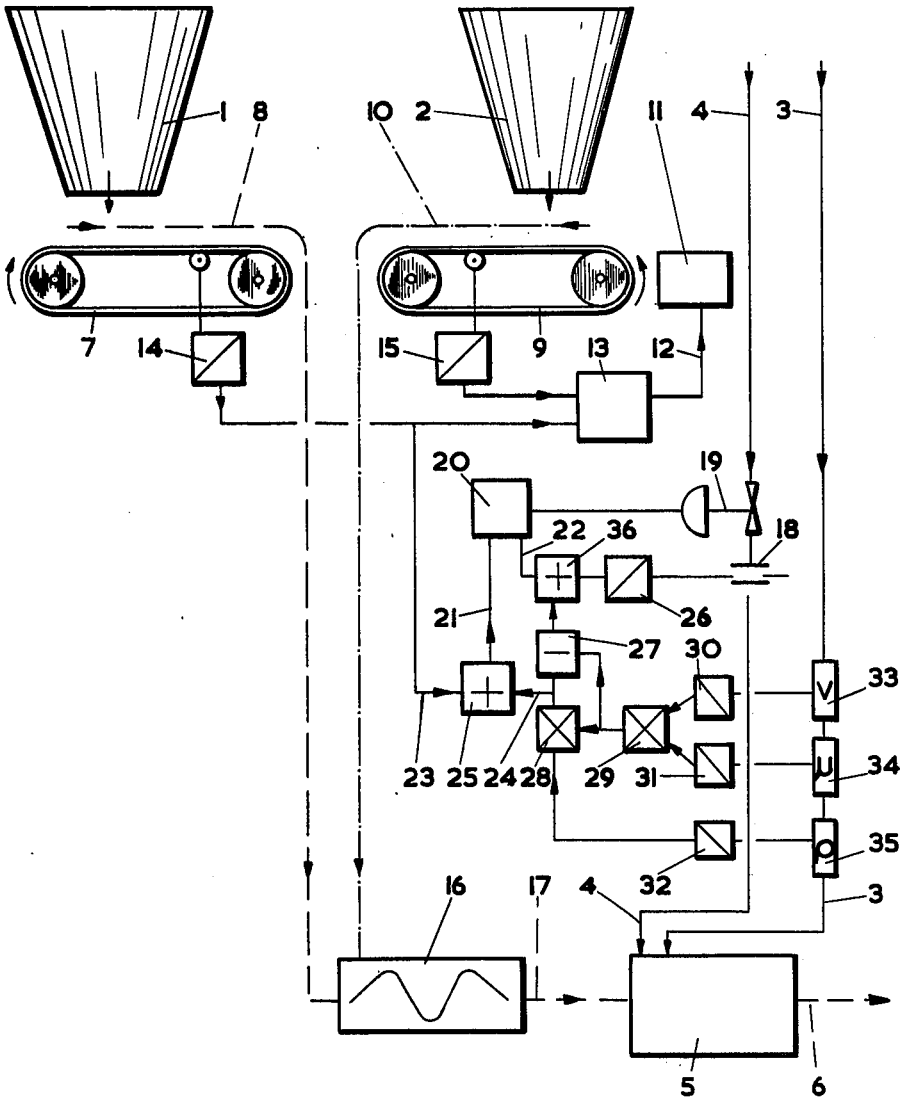
FIG. 1 illustrates a diagrammatic flow sheet of a process carried out in accordance with the present invention.

In FIG. 1 an ore powder hopper and a bentonite hopper are indicated by reference numerals 1 and 2, respectively. Water containing ore powder (spilled water, slurry from flushing and the like) and unpolluted water are fed through lines 3 and 4, respectively, into the units to be used in carrying out the process. A flow of material 6 passes from mixer 5 and is thereafter fed to pellet forming drums or dishes in order to have the material rolled into moist pellets therein.

A flow of ore powder 8 is drawn from the hopper 1 by a belt feeder 7, said flow being indicated in the drawing by a dashed line. In the same manner, a flow of bentonite 10 is drawn from the hopper 2 by a belt feeder 9, said flow being indicated in the drawing by a dot and dash line. The flows 8 and 10 of ore powder and bentonite, respectively, are fed to a single-helix-mixer 16, from which the dry mixture is passed as a flow 17 to the mixer 5.

In close proximity to the front end of the mixer 5, the two flows 3 and 4 of "polluted" and "pure" water respectively are introduced into the mixture, whereupon the entire mass is homogenized in the mixer 5. While being homogenized the mass is simultaneously conveyed to the opposite end of the mixer 5 from where the homogenized material is conveyed to the forming plant for the moist pellets through line 6.

The mixer 5 consists of a horizontal cylindrical drum having asymmetric plough-shares mounted for rotation therein. It has been noted hereinbefore that such apparatus is manufactured by the firm of Lodige located in the German Federal Republic. Of the four mass flows 3, 4, 8 and 10 fed to the process, the flows 10 and 4 may be adjusted. With the aid of such flows, the bentonite content and the water content of the final mixture respectively may be adjusted. Flow 10 (bentonite) is adjusted by varying the speed of the driving motor 11 of belt feeder 9. The adjustment signal 12 is produced by a control device 13 by which the ore powder : bentonite ratio is maintained at a constant value. To this end, the control device 13 is fed with signals from the measuring devices 14 and 15, by which the quantity of the flows 8 and 10 per unit time is being continuously determined. This may be carried out, for instance, with the aid of belt weighing scales placed in contact with the belt feeders, as is diagrammatically shown in the drawing.

The mixture of water and ore powder is passed into the process through line 3 in an undetermined flow which is immediately fed into the process system of the front end of the mixer 5. Without having any effect on said flow, the measuring apparatus 33, 34 and 35 measure the volume flowing therethrough on a per unit time basis, the permeability thereof and the absorption of gamma-radiation therein. Inasmuch as the measuring of the volume flow is achieved with the aid of an electromagnetic flow meter 33, the resulting signal has to be corrected by determining the permeability $\mu$ in the apparatus 34. The signals produced by the measuring apparatus 33 and 34 are converted in the convertors 30 and 31 into signals, with which a corrected signal for the volume flow may be obtained in the multiplying device 29. The corrected signal is combined in the multiplier 28 with the signal by which the density $\rho$ is determined by the convertor 32.

This results in a signal 24 which is representative of the mass of the ore powder in the flow of water 3. In the addition device 25, the signal 24 of the mass flow is added to the signal 23 which is representative of the quantity of flow of the metering belt feeder 7 from which a signal 21 is subsequently obtained. This last-mentioned signal 21 is a criterion of the total of the ore mass to which the distribution of water is to be adjusted.

The adjustment occurs with the aid of the control device 20, by which the signals 21 and 22, which are criteria of the total flow of ore and the total flow of water respectively, are adjusted to a constant ratio. The correction signal at the exit of the control device 20 is used to adjust the control valve 19 in the pipe of the flow of "pure" water 4.

Signal 22 is formed in the addition device 36 from signals produced by the convertor 26 and the subtracting device 27, which signals are the criteria of the volume flows of water 4 and 3.

To this end, an orifice plate 18 is included in the flow line 4, while the subtracting device 27 is connected in a manner such that it determines the difference between the signals produced by the multipliers 29 and 28, which signals indicate the total flow and the flow of ore through pipe 3 respectively.

In the manner described above, it will be possible to adjust the water content in the final mixture to within 0.1% accurately, even if there occur relatively substantial fluctuations in the supply of water and ore powder in the flow 3.

It is to be noted that with such substantial fluctuations no correction is made in the metering of the bentonite. Inasmuch as the fluctuations in the total flow of ore resulting from substantial fluctuations in the flow 3 of ore loaded water may at most amount to the order of magnitude of a few percentage point, and inasmuch as the total metering of the bentonite is on the order of a magnitude of 0.4% of that of the ore powder, it will be noted that such a correction in the bentonite metering is neither imperative nor useful.

Figure 2:
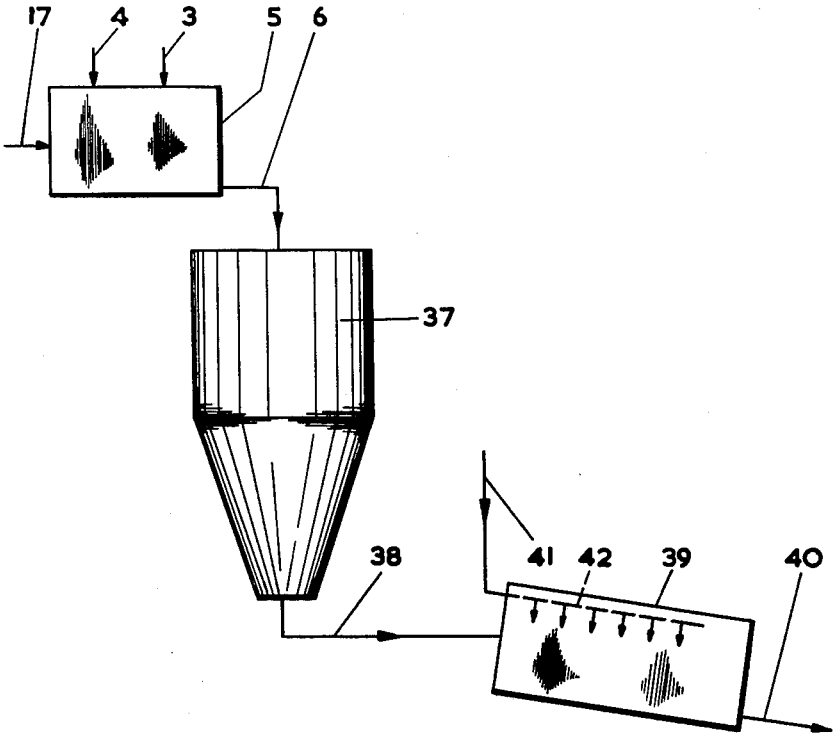
FIG. 2 illustrates in greater detail part of the flow sheet of FIG. 1 with additional parts of equipment.

In FIG. 2 the mixer 5 is again shown, with the supply lines 3, 4 and 17 passing thereinto, as in FIG. 1. Similarly, the mixer 5 is provided with a discharge line 6 passing to the forming plant for the moist pellets. The prepared mixture from mixer 5 is fed along discharge line 6 to a storage hopper 37, from which the material is passed along a line 38 to a cylindrical drum 39. This drum is driven so as to rotate around the axis of its cylindrical shape, so that the moist mixture is formed therein into pellets by rolling actions, with the pellets so formed leaving the drum through line 40.

During the forming of this mixture into pellets in drum 39, 0.4 to 0.5% of water is added thereto from water pipe 41. The added water is sprayed substantially evenly and uniformly onto the mixture by means of a duct 42 extending axially of the cylindrical drum 39 as shown and having a large number of spray openings along a considerable part of the length of the drum formed therein. The drums may have a diameter of about 3 meters and a length of about 10 meters. If the water is added to the mixture in the usual way at the entrance opening of duct 41 into drum 39, each drum would be able to produce about 100 tons of pellets a day. By applying the described improvement of supplying water along a longer zone in the drum, it is possible for the same drum to produce 135 tons of pellets a day.

What we claim is:

1. A process for the manufacture of ore pellets comprising mixing a fine ore powder having a moisture content of less than 0.1% and consisting essentially of particles having a size less than 90 $\mu$ with 0.05 to 1% by volume of a powdered adhesive, adding 8 to 9% of water by weight to said mixture while said mixture is at a temperature of 50° to 90° C, homogenizing the mixture by a ploughing action to produce a moist mixture consisting essentially of fine ore powder, less than 1% of adhesive and about 8% of water, forming pellets from said moist mixture by a rolling operation and thereafter baking said formed pellets to produce the desired pellets.

2. A process in accordance with claim 1, wherein the fine ore powder employed as a starting material therein consists of particles of which about 65% thereof has a particle size of less than 40 $\mu$.

3. A process in accordance with claim 1, wherein the adhesive employed therein is bentonite.

4. A process in accordance with claim 1, wherein the homogenizing of the moist mixture is carried out at a temperature in the range of 60° to 70° C and about 0.4 to 0.5% additional water is added to said mixture during the rolling operation to form the pellets.

5. Baked ore pellets prepared in accordance with the process of claim 1.

* * * * *